US012558755B2

(12) United States Patent
Morin et al.

(10) Patent No.: US 12,558,755 B2
(45) Date of Patent: Feb. 24, 2026

(54) BELT LOADING METHOD AND DEVICE FOR MATERIAL REMOVAL TOOL

(71) Applicant: PRATT & WHITNEY CANADA CORP., Longueuil (CA)

(72) Inventors: Philippe Morin, Beloeil (CA); Thomas Roux, Montreal (CA); Guillaume Fortier, Saint-Sauveur (CA); Canam Hoang, Longueuil (CA); Guillaume Whittom, Saint-Hubert (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 660 days.

(21) Appl. No.: 17/645,532

(22) Filed: Dec. 22, 2021

(65) Prior Publication Data

US 2023/0191552 A1 Jun. 22, 2023

(51) Int. Cl.
*B24B 21/18* (2006.01)
*B24B 21/16* (2006.01)

(52) U.S. Cl.
CPC ..... *B24B 21/18* (2013.01); *B24B 21/16* (2013.01)

(58) Field of Classification Search
CPC ..... B24B 21/18; B24B 23/06; B24D 15/023
See application file for complete search history.

(56) References Cited

U.S. PATENT DOCUMENTS 8,512,096 B2 8/2013 Ahti et al.
8,784,162 B1 * 7/2014 Dovel ..... B24B 21/20 451/303
10,112,281 B2 10/2018 Rose et al.
10,137,553 B2 11/2018 Huang et al.
10,155,295 B2 12/2018 Huang et al.
10,287,890 B2 5/2019 Andreou et al.
2007/0243799 A1 * 10/2007 Fuchs ..... B24B 21/002 451/296
2015/0336557 A1 * 11/2015 McNeil, Sr. ..... B60T 17/223 254/104

FOREIGN PATENT DOCUMENTS

EP 3385030 A1 10/2018
WO 20210009654 A1 1/2021

OTHER PUBLICATIONS

European Search Report issued in counterpart application 22216179.6 on May 9, 2023.

* cited by examiner

*Primary Examiner* — Brian D Keller
*Assistant Examiner* — Jason Khalil Hawkins
(74) *Attorney, Agent, or Firm* — NORTON ROSE FULBRIGHT CANADA LLP

(57) ABSTRACT

A belt loading device for loading an abrasive belt in a closed loop configuration on a machining tool is disclosed. The device includes a base support and a movable part engaged to the base support. The movable part is movable relative to the base support between a biased position and a belt releasing position, the base support and the movable part, while in the biased position, cooperating to maintain the abrasive belt in a fixed position defining a tool engaging area circumscribed by an inner surface of the abrasive belt. A biasing member interfaces between the base support and the movable part to bias the movable part into the biased position.

14 Claims, 7 Drawing Sheets

BELT LOADING METHOD AND DEVICE FOR MATERIAL REMOVAL TOOL

TECHNICAL FIELD

The application relates generally to robotic work cells and, more particularly, to surface treatment or material removal tools and devices for such cells.

BACKGROUND OF THE ART

Surface treatment such as polishing, deburring, sanding or grinding of fan, fan blades or other engine components may be made manually or as part of an automated process. Tools for such tasks, e.g., belt sanders, may include abrasive/polishing components, such as abrasive/polishing belts mounted for rotation about belt engaging idlers driven by a powered device, e.g. pneumatic, hydraulic, electric, etc. Frequent belt replacements may be required during a polishing operation. Manual replacements of such belts may be time consuming. In addition, cyclic manual replacement of belts may monopolize labor time during a surface treatment operation, which may increase the overall runtime of such operation, and/or which may reduce the labor's efficiency in performing other tasks. Proper health and safety measures may be required if such belt replacements occur in a robotic work cell, which may impact downtime between subsequent operation cycles, for instance.

SUMMARY

In one aspect, there is provided a belt loading device for loading an abrasive belt in a closed loop configuration on a machining tool, comprising: a base support; a movable part engaged to the base support, the movable part movable relative to the base support between a biased position and a belt releasing position, the base support and the movable part, while in the biased position, cooperating to maintain the abrasive belt in a fixed position defining a tool engaging area circumscribed by an inner surface of the abrasive belt; and a biasing member interfacing between the base support and the movable part to bias the movable part into the biased position.

In another aspect, there is provided a method for loading a belt in a closed loop configuration on a machining tool as part of an automated machining operation, the method comprising: engaging a first end portion of the machining tool with an inner surface of the belt supported by a belt loading device in the closed loop configuration; engaging the machining tool with a movable part of the belt loading device; displacing the movable part from a biased position to a belt releasing position; engaging a second end portion of the machining tool with the inner surface of the belt; disengaging the machining tool from the movable part in the belt releasing position; and freeing the belt from the belt loading device with the machining tool.

DESCRIPTION OF THE DRAWINGS

Reference is now made to the accompanying figures in which.

DETAILED DESCRIPTION

Figure 1:
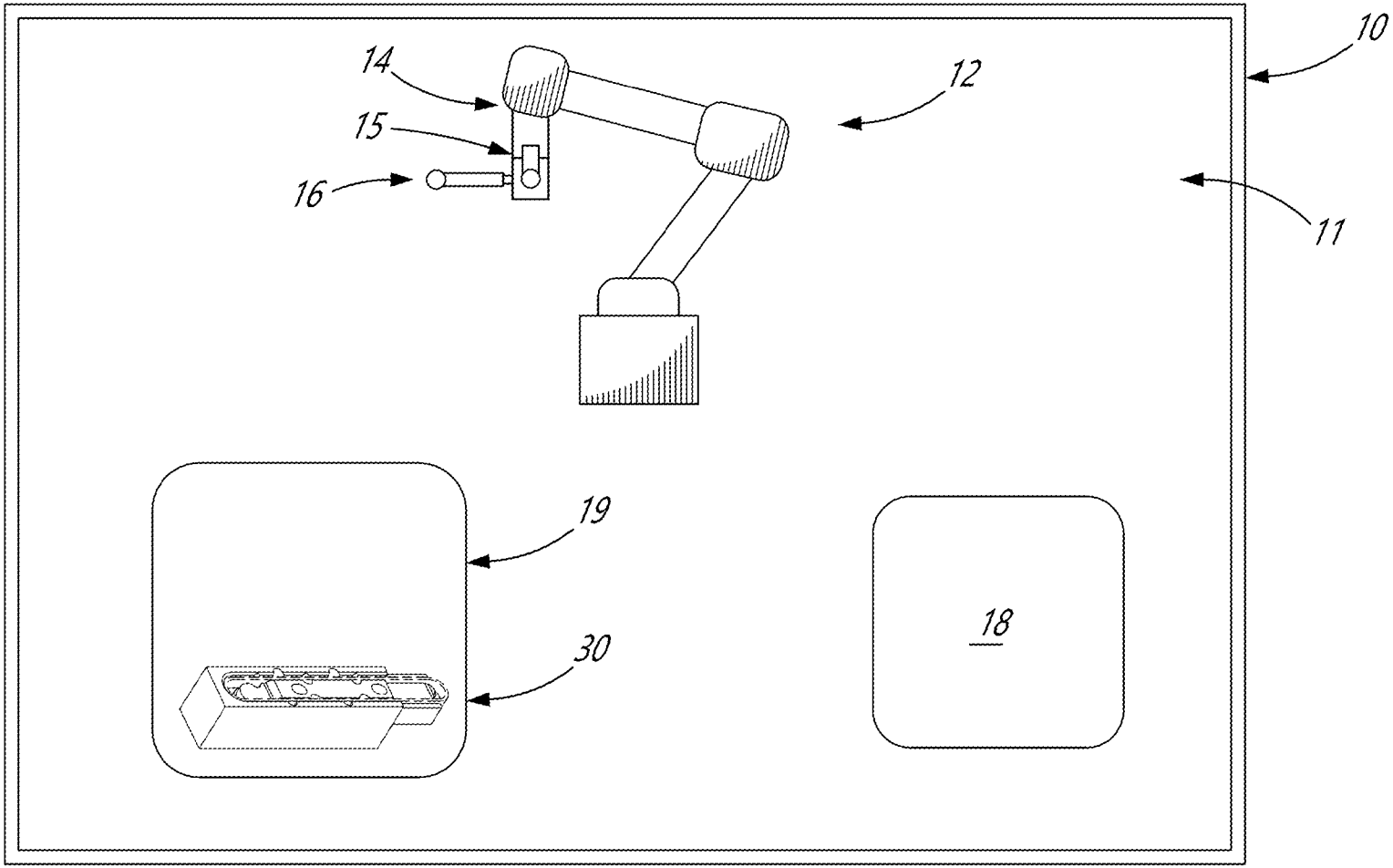
FIG. 1 is a schematic representation of an exemplary robotic work cell.

FIG. 1 illustrates an exemplary robotic work cell 10. The work cell 10 includes a robot 12 operable to perform automated tasks. The robot 12 has a robotic arm 14 and a mounting end 15, which may include a flange, adapted to mount a machining tool 16 thereon. The robot 12 is programmable, by a programmer, for instance, to achieve one or more machining tasks. The robotic arm 14 may allow complex motions of the machining tool 16 within a work space, which may be defined by an internal volume of the work cell 10, in a plurality of degree of freedom (translational and/or rotational) by moving arm segments of the robotic arm 14. Such robotic arm 14 may allow movement of the machining tool 16 to adjust its spatial orientation and move it along a controlled trajectory. Precise three-dimensional displacements of the machining tool 16 may be achieved to perform machining tasks on a workpiece or component 18. The component 18 may be an aircraft component, or other large components. Other components 18, e.g., non-aircraft components, are contemplated as well. For instance, the work cell 10 and machining tool 16 may be contemplated for material removal applications in general with a similar machining tool design and belt type abrasive.

Figure 2:
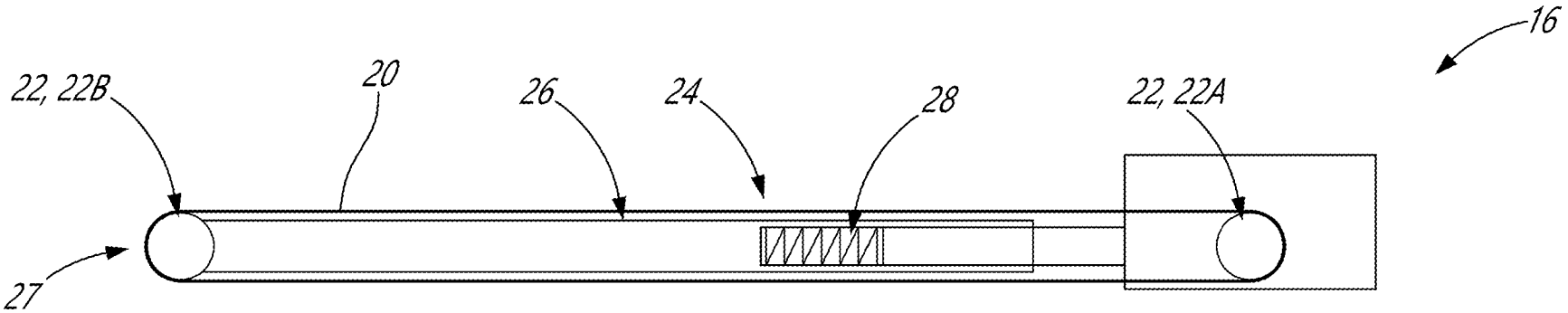
FIG. 2 is a schematic representation of an exemplary machining tool mountable to a robotic arm of a robot of the robotic work cell of FIG. 1.

In at least some applications, the work cell 10 is a polishing work cell and the machining tool 16 is a material removal tool, which may also be referred to as a surface treatment tool. FIG. 2 illustrates a schematic, exemplary machining tool 16. In the depicted embodiment, the machining tool 16 may be referred to as a belt sander, or a file belt sander for instance. The machining tool 16 may be adapted to connect to the mounting end 15 of the robotic arm 14, either as having a universal mounting interface, or a mounting interface specifically designed for attachment to a given robot 12 and/or robotic arm 14.

The machining tool 16 includes a replaceable abrasive belt 20. Such belt 20 may be referred to as polishing or sanding belt as well. Such belt 20 may have a range of grit depending on the polishing, grinding, sanding, deburring, deflashing, etc., application. In some cases, a polishing paste with one such belt 20 for certain surface finishing. The belt 20 is flexible. The belt 20 may have a fixed length, i.e., unextendable, under normal operating conditions or allow non-permanent (elastic) stretching under tension and temperature, as another possibility. The dimensions of the belt 20 may vary depending on the embodiments and machining tool 16. The dimensions of the belt 20 may be adapted to fit with a given machining tool 16. The belt 20 may have standardized dimensions to fit with various off-the-shelf machining tools, or be adapted to fit to a custom tool as another possibility. The dimensions of the belt 20, may be subject to rather loose manufacturing tolerances meaning their circumference may change by a few millimeters, in some cases.

The belt 20 has a closed loop configuration and is mounted as such onto the machining tool 16. The belt 20 is mounted about a plurality of idlers 22 and in driving engagement therewith. In the depicted embodiment, the machining tool has a driving idler 22A, a driven idler 22B and a tensioner 24 between the driving idler 22A and the driven idler 22B to apply a tension load to the belt 20 mounted about the idlers 22. There may be more idlers 22, either driving or driven, in other embodiments, for instance more than one driving idler 22A and/or more than one driven idler 22B. The driven idler 22B may be referred to as a "free idler", meaning that it is not powered as the driving idler 22A can be. The driving idler 22A is operably engaged to a power source, which may be an electric source or motor, a pneumatic source or motor, etc. A transmission, such as a gear box, a reductor, or other types of transmission, may interconnect the power source and the driving idler. Other belt engaging components than idlers may be contemplated, such as other types of rolling elements, e.g., rollers, bearings, gears.

In the depicted embodiment, the tensioner 24 includes an extendable rod 26 and a biasing member 28. The biasing member 28 may bias the extendable rod 26 in an extended state. The biasing member 28 may include a spring, a damper, a spring and damper system, or other biasing components, such as a cam assembly or other suitable mechanisms to apply a load of the tensioner 24 to maintain a tension on the belt 20 and/or the extendable rod 26 in the extended state. In the extended state, the extendable rod 26 stretch the belt 20. The stretching may not elastically deform the belt 20 in at least some cases, though stretching could elastically stretch the belt 20 in other cases. An external load applied axially or at least partially axially against an end 27 of the extendable rod 26 may retract the extendable rod 26 in a retracted state. In the retracted state, the extendable rod 26 is shorter than in the extended state. In the retracted state, the belt 20 may be released and/or under less to no tension. The belt 20 may then more easily disengage the driven idler 22B and/or the driving idler 22A when the extendable rod 26 is in the retracted state.

Returning to FIG. 1, the work cell 10 may define a closed area or work space 11, which may be limited by barriers, walls or other physical boundaries. In operation, the robot 12 of the work cell 10 may move at high speed and/or the machining process, such as polishing, sanding, or other surface treatment processes or other machining processes performed may generate contaminants, such as dusts, particles, or vapors which may render desirable to have the robot 12 in a confined space and/or to limit access to the work space 11 during operation.

In a surface treatment process performed within a work cell as the work cell 10, an abrasive component such as the belt 20 of the machining tool 16 may wear and cyclic replacement thereof during such surface treatment process may be contemplated. It may be desirable to automate the cyclic replacement of such abrasive component on the machining tool 16 without or with limited manual handling of the machining tool 16 and/or without accessing the work space of the work cell 10 after each life cycle of the abrasive component. This may reduce downtimes to remove manually a worn out belt 20 from the machining tool 16 and replace it with another belt 20 (new or in better condition). This would involve, for instance, entering the work cell 10, which may be undesirable for time efficiency and/or health and safety reasons, for example. A belt loading device 30 is illustrated within the work space 11 defined by the work cell 10.

The belt loading device 30 may be part of a support rack 19. In an embodiment, the work cell 10 may include a plurality of such belt loading device 30. The belt loading device(s) 30 may be mounted on a support rack 19 of the work cell 10, with the support rack 19 disposed in an area within the work cell 10. The support rack 19 may be in the vicinity of the robot 12, at a reachable distance by the robotic arm 14. The support rack 19 may be fixed or movable with respect to the robot 12 depending on the embodiments. The support rack 19 may include a frame on which a plurality of the belt loading device 30 may be mounted. Prior to performing a polishing process on a component such as the component 18 with the work cell 10, an operator may mount a plurality of the belt loading device 30 each including an abrasive belt, such as belt 20, onto the support rack 19.

The belt loading devices 30 may be viewed as cartridges of replacement abrasive belts 20 for the robot 12 equipped with a machining tool, as the machining tool 16 described above. Such cartridges may be pre-loaded with belts 20 by an operator, or as part of an automated process, for instance, beforehand or during the material removal process in the work cell 10 if the belt loading devices 30 may be moved in a safe location. During a polishing operation, once the belt 20 mounted onto the machining tool 16 on the robot 12 is worn out, or at another desired moment, the belt 20 that is worn out may be unloaded from the machining tool 16 on the robot 12. The robot 12 may subsequently reach the support rack 19 for loading another belt 20 of one of the belt loading device 30 on the machining tool 16. The robot 12 having the robotic arm 14 equipped with the machining tool 16 may be programmed so as to load a belt 20 of one of the belt loading devices 30 onto the machining tool 16 by engaging with that belt loading device 30, as will be described later.

Figure 3:
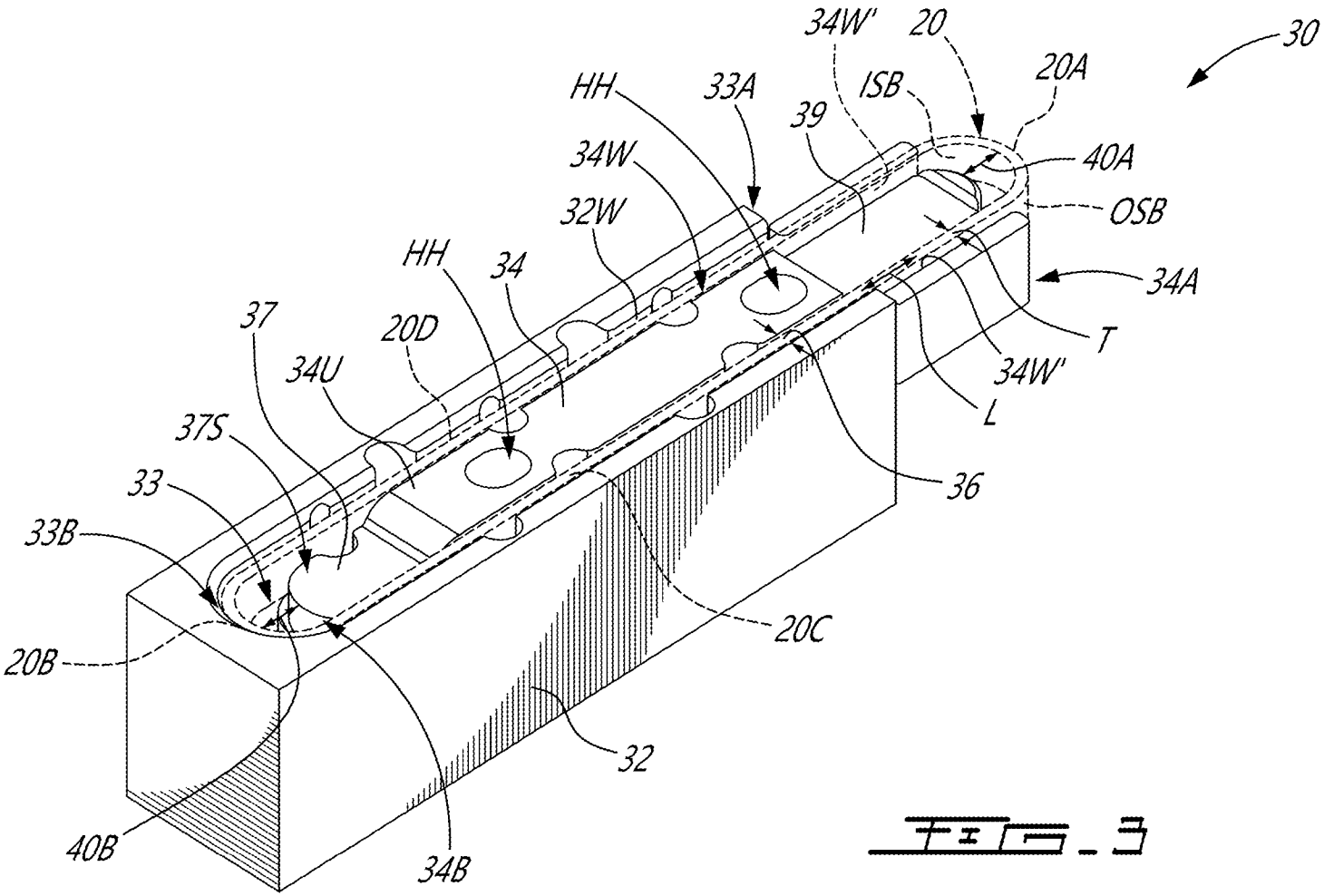
FIG. 3 is a perspective view of a belt loading device of the robotic work cell of FIG. 1 with the surface treatment tool of FIG. 2.
Figure 4B:
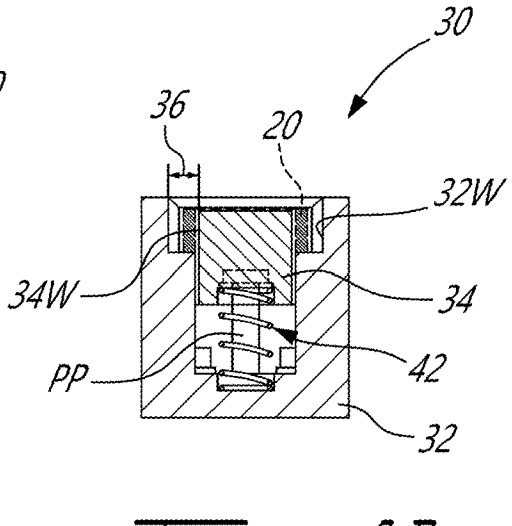
FIG. 4B is a cross-section 4B-4B of FIG. 4A.
Figure 4A:
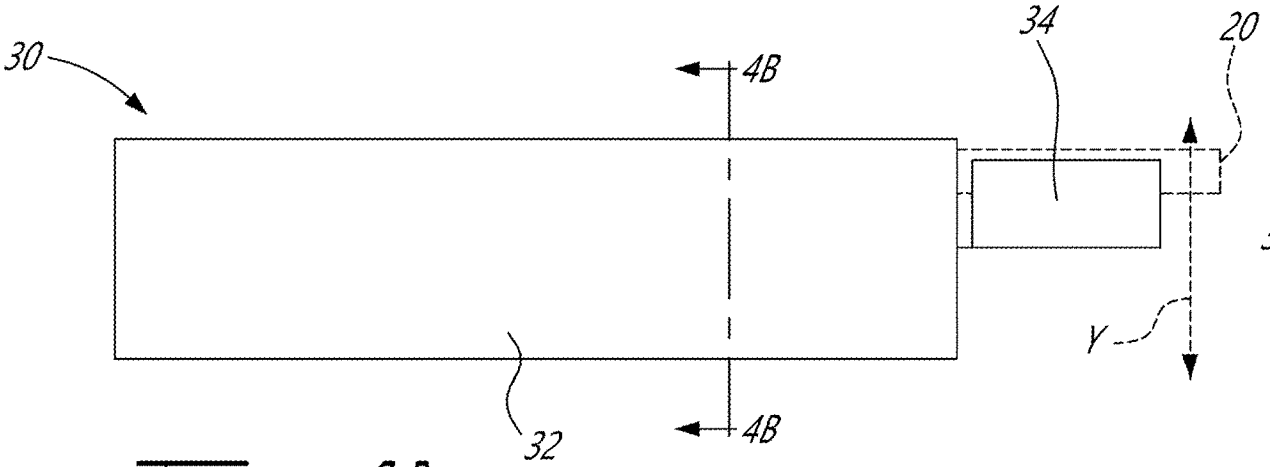
FIG. 4A is a side elevation view of the belt loading device of FIG. 3.
Figure 5B:
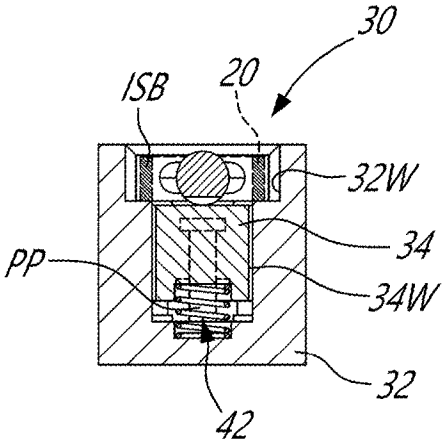
FIG. 5B is a cross-section 5B-5B of FIG. 5A.
Figure 5A:
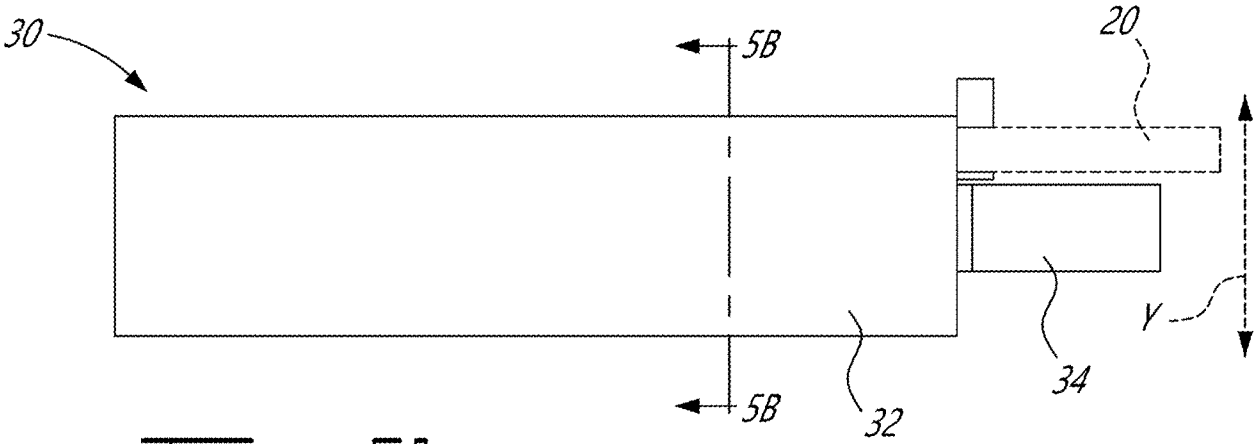
FIG. 5A is another side elevation view of the belt loading device of FIG. 3.

FIG. 3 illustrates an example of a belt loading device 30 which may be part of the work cell 10. The exemplary belt loading device 30 includes a base support 32, which may be mounted to the support rack 19 of the work cell 10, if the support rack 19 is present. The belt loading device 30 also includes a movable part 34 engaged with the base support 32. The movable part 34 is mounted to the base support 32, and movable relative to the base support 32. Although movable relative to the base support 32, the movable part 34 may be secured to the base support 32, by one or more screws or guiding pins (see FIG. 4B) interconnecting the base support 32 and the movable part 34 and allowing a movable engagement of the movable part 34 relative to the base support 32. Interlocking features between the movable part 34 and the base support 32, such as interlocking tabs, to retain the movable part 34 to the base support 32, could be contemplated in other cases. The movable part 34 is biased towards a first position (or "biased position") relative to the base support 32 in which the movable part 34 and the base support 32 cooperate to maintain the belt 20 in a fixed position. Such biased position is illustrated in FIGS. 3, 4A-4B. The machining tool 16 may initiate an engagement with the belt 20 in the fixed position supported by the belt loading device 30 when the movable part 34 is in the biased position. The movable part 34 may be forced to move progressively from the biased position to a second position (or "belt releasing position"). The movable part 34 may oppose continuously to the machining tool 16, i.e. force against the machining tool 16 during such movement. Such belt releasing position is illustrated in FIGS. 5A-5B. The machining tool 16 may pursue and/or complete the engagement of the belt 20 while the movable part 34 is in the belt releasing position. Once engagement with the belt 20 is complete, the machining tool 16 may move away from the belt loading device 30, taking away the belt 20 with it. The movable part 34 may return to the biased position, as the machining tool 16 moves away. The base support 32 and the movable part 34 are thus unloaded (or "emptied of") of the belt 20. Another belt 20 may then be installed in the belt loading device 30 for a subsequent belt loading process In at least some embodiments, in the fixed position, the belt loading device 30 applies a limited or no tension on the belt 20. The belt 20 may not be stretched permanently or non-permanently when mounted onto the belt loading device 30. Because of the inherent flexibility of the belt 20, the belt 20 may not maintain the fixed position without external assistance. The base support 32 and the movable part 34 may provide such assistance, so as to facilitate engagement of the machining tool 16 with the belt 20 during a belt replacement process by constraining the belt 20 in a desired shape.

The fixed position of the belt 20 may be referred to as a tool engaging position. In at least some embodiments of the belt loading device 30, such as shown, in the fixed position, the belt 20 has an obround shape, which may also be referred to as a stadium shape. The obround shape is defined by an inner surface ISB of the belt 20, which is opposite an outer surface OSB or abrasive surface of the belt 20. The inner surface ISB defines a periphery of a tool engaging area, in which the machining tool 16 may initiate engagement with the belt 20. The obround shape defines a pair of opposite semicircle segments or radius corners 20A, 20B. As shown, the belt 20 has opposite straight or substantially straight segments 20C, 20D extending between the radius corners 20A, 20B. In other words, the radius corners 20A, 20B are connected by the segments 20C, 20D. The segments 20C, 20D may be parallel to each other, for instance where the radius corners 20A, 20B have the same or substantially the same curvature. The radius corners 20A, 20B may receive respective ones of the idlers 22 of the machining tool 16, as will be described later. In at least some embodiments, an obround shape, such as shown may be the closest shape from an outline of the closed loop configuration of the belt 20 when mounted to the machining tool 16. In other embodiments, the belt 20 in the fixed position may have a different shape (e.g., oblong, oval, ellipse, circle, rectangle with rounded corners, squircle) allowing engagement of the machining tool 16 with the inner surface ISB of the belt 20.

The base support 32 defines a slot 33 in which at least part of the movable part 34 and/or the belt 20 is received when the movable part 34 is in the biased position. In the depicted embodiment, the slot 33 is open-ended at an end 33A thereof. A portion of the movable part 34 extends beyond a side of the base support 32, beyond the open-ended end 33A of the slot 33. This configuration may provide more clearance and/or prevent collisions with the base support 32 for the machining tool 16 and/or robotic arm 14 during engagement of the machining tool 16 with the movable part 34 and/or idler 22 with the belt 20 during the belt loading process. The movable part 34 may entirely be recessed (or "contained") within the slot 33, for instance as the base support 32 may surround, entirely, a periphery of the movable part 34 in some variants of the belt loading device 30.

In the depicted embodiment, the slot 33 has a closed end 33B opposite the open-ended end 33A. The closed end 33B defines a radius corner adapted to receive the radius corner 20A of the belt 20. In other words, the belt 20 may engage with the closed end 33B. The radius corner 20A may interface between the machining tool 16 and the closed end 33B of the slot 33 during the belt loading process. The closed end 33B may allow abutment of the machining tool 16 as it presses against the inner surface ISB of the belt 20 during the belt loading process, which will be further described later. Abutment against the closed end 33B may reduce tensile stress in the belt 20 during the belt loading process and/or limit uncontrolled displacement of the belt 20 relative to the belt loading device 30 during such process. Abutment opposing the pressure exerted by the machining tool 16 during the belt loading process may be performed by another component, for instance a stopper separate from the base support 32. Opposing the pressure exerted by the machining tool 16 in the radius corner 20A of the belt 20 during the belt loading process may be taken up by the tension of the belt 20, though it might be desirable to limit such tensile stress in the belt 20, as set forth above. Radius of such closed end 33B may be selected so as to allow differently sized idlers 22 engaging therewith, depending on the variants of machining tool 16 and/or allow some flexibility in the robot's motion.

At least when the movable part 34 is in the biased position and the belt 20 in the fixed position, at least part of the belt 20 extends between portions of respective ones of the base support 32 and the movable part 34. In the depicted embodiment, a substantial portion of the belt 20 is supported on both sides thereof. As shown, a substantial portion of the belt 20 is recessed in the base support 32. Also shown, the movable part 34 occupies part (at least) of the tool engaging area, in the biased position. A substantial portion (e.g., more than 75%) of the inner surface ISB and outer surface OSB of the belt 20 is located (e.g., more than 75%) between opposite walls 32W, 34W of respective ones of the base support 32 and the movable part 34. As shown, the wall 32W of the base support 32 extend about at least part of the movable part 34. In other words, the wall 32W surrounds a substantial portion of the movable part 34. The wall 34W of the movable part 34 defines a periphery of the movable part 34. While walls 32W, 34W are shown as continuous walls, such walls may be segmented in other embodiments. For instance, a series of spaced apart pins may define interrupted walls 32W, 34W in other cases. In at least some embodiments, a substantial portion (more than 75%) of the full length L (i.e., full circumferential dimension) of the belt 20 is located in a gap 36 defined between the opposite walls 32W, 34W. Less than 75% could be contemplated, e.g., between 50% and 75% in other cases. Such gap 36 has a gap distance which may be between 100% and 200%, in a particular case 125%±15% of the maximal thickness T of the belt 20 to receive the belt 20 therein and maintain the desired shape in the fixed position. The belt 20 naturally pushing against the outer surface OSB may provide a sufficient normal force to generate a static friction force maintaining the belt 20 in position. Because of an inherent stiffness of the belt 20, support of the belt 20 along a substantial portion of its length while it is maintained in the fixed position may better hold the shape of the belt 20 and stabilize it in the belt loading device 30 pending the belt loading process onto the machining tool 16 and/or cause less variation in the position of the belt 20 from one belt loading device 30 to another when a plurality of those are present in the work cell 10 for a polishing operation requiring a number of replacement of belts, for instance. The automated loading process may thus be performed more reliably.

In at least some embodiments, such as shown, the portion of the movable part 34 extending beyond the side of the base support 32 includes outer support walls 34W' opposite the wall 34W facing the inner surface ISB of the belt 20. The outer support walls 34W' face the outer surface OSB of the belt 20. The outer support walls 34W' extend parallel to the walls 32W of the base support 32, in the embodiment shown. The gap 36 discussed above between walls 32W, 34W may extend between the walls 34W facing the inner surface ISB of the belt 20 and the outer support walls 34W' of the movable part 34. The outer support walls 34W' may be offset (slightly offset) relative to those walls 32W in other embodiments. The outer support walls 34W' may provide additional lateral support on the outer surface OSB of the belt 20, which may even better hold the shape of the belt 20 in embodiments where the movable part 34 extend beyond the side of the base support 32. In an embodiment, with the walls 34W, 34W' of the movable part 34 and walls 32W of the base support 32 as shown, at least 90% of the length L of the belt 20 may be supported laterally on both sides thereof. Such proportion of the length L may be less in other embodiments, for instance where the walls are segmented or where the walls are rather a series of spaced apart pins disposed along the profile of these walls.

In at least some embodiments, such as shown, a recess 37 is defined in an upper face 34U of the movable part 34 at an end 34B of the movable part 34. As shown, the end 34B with the recess 37 is on the closed end side of the belt loading device 30, opposite the open-ended end 33A of the slot 33. The recess 37 defines a space 37S (or empty volume) in which the driven idler 22B of the machining tool 16 may be inserted to engage the inner surface ISB of the belt 20 during the belt loading process. The space 37S is delimited at a bottom by the upper face 34U, at a top by a plane extending along a top surface of the base support 32, and surrounded by the wall 32W of the base support 32, as shown. The recess 37 may limit or avoid contact between the driven idler 22B and the movable part 34 when the machining tool 16 initiates engagement with the inner surface ISB of the belt 20. It may enable the driven idler 22B to be inserted behind the inner surface ISB of the belt 20 and to push it against the radius corner 20B before initiating the compression of the tensioner 24. This may limit or prevent movement of the movable part 34 at such stage of the process, which may limit displacement of the belt 20 at that stage. Wears of the machining tool 16 by repetitive contact with movable parts 34 of belt loading devices 30 may also be better controlled this way.

In at least some embodiments, such as shown, another recess 39 may be defined in the upper face 34U of the movable part 34, at the other end 34A of the movable part 34. As shown, the portion of the movable part 34 that extends beyond the open-ended end 33A of the slot 33 has such recess 39. Such recess 39 may limit interference between the machining tool 16 and the movable part 34 when the machining tool 16 initiates the engagement with the belt 20 at the closed end of the slot 33. A depth of such recess 39 may be minimized in some embodiment, so as to limit a propensity to have the belt 20 slipping into the recess 39 and getting stuck therein, between the driving idler 22A and the movable part 34 when the belt 20 is released from the device 30.

In the biased position, the movable part 34 is located in the tool engaging area circumscribed by the inner surface ISB of the belt 20. The movable part 34 has a length smaller than that of the tool engaging area, in a direction extending between the opposite radius corner 20A, 20B. In the depicted embodiment, a clearance 40A, 40B is defined between the inner surface ISB of the belt 20 in the radius corners 20A, 20B and the respective ends of the movable part 34. Such clearance 40A, 40B may facilitate the engagement of the idlers 22 of the machining tool 16 during the belt loading process and/or avoid undesirable pinching and/or squeezing of the belt 20 between the machining tool 16 and the belt loading device 30 during the belt loading process. In the depicted embodiment, the clearance 40A, 40B has a dimension taken along the length of the movable part 34 that is approximately equal to (±10%) the radius of the radius corner 20A, 20B of the belt 20. The dimension of the clearances 40A, 40B may be smaller, e.g., more than 10% smaller than the radius of the radius corner 20A in other embodiments. It may be desirable to minimize the dimension of the clearances 40A, 40B so as to hold the shape of the belt 20 and stabilize it over a maximized portion of its length L in the belt loading device 30 pending the belt loading process. In an embodiment, for instance such clearances 40A, 40B may have the same dimension as the gap distance between the opposite walls of the base support 32 and the movable part 34. This may apply to one or both of the clearances 40A, 40B. One or both of the clearances 40A, 40B may have a different dimension in other embodiments.

Referring to FIGS. 4A-4B and 5A-5B, the belt loading device 30 is represented in the biased position and in the belt releasing position, respectively. A displacement axis Y is illustrated in FIGS. 4A and 5A. The movable part 34 moves in a direction along the axis Y relative to the base support 32. The belt 20 may rest on tabs defined in the base support 32, as shown. The tabs, defining plateaued surfaces facing upwardly to receive edge of the belt 20, may support the belt 20 along a least part of its length L, as shown in FIGS. 4B and 5B. In the belt releasing position, as shown in FIGS. 5A-5B, the movable part 34 is retracted into the base support 32 so as free at least partially the tool engaging area and/or the inner surface ISB of the belt 20. The movable part 34 is removed at least partially from the tool engaging area as the machining tool 16 takes up the tool engaging area to engage with the belt 20.

Movement of the movable part 34 relative to the base support 32 may be guided, for instance by one or more guiding pins or other guiding features, e.g., slots, rails, rollers. In the depicted embodiment, guiding pins PP (FIG. 4B) extending from the base support 32 and through holes HH (FIG. 3) in the movable part 34 movably retain the movable part 34 on the base support 32 and guide the relative movement therebetween. The guiding pins PP may be screws, rods, pins, affixed to the base support 32, for instance. As shown in FIG. 4B, the guiding pins PP have a s crew head on which the movable part 34 may abut axially, along displacement axis Y to act as a "stopper", in the biased position. In the depicted embodiment, the holes HH are oblong slots, which are parallel to a longitudinal extent of the movable part 34. The guiding pins PP are sized to move loosely into the holes HH. Guided movement of the movable part 34 may thus be in a plurality of degrees of freedom. For instance, the guided movement of the movable part 34 may allow movement along the displacement axis Y, which may be referred to as a up-down movement, and in a transverse direction along the longitudinal extent of the oblong shape of the holes HH. Movement of the movable part 34 may include a rotational movement as well (e.g., distinct movement of opposed ends of the movable part 34). As such, in the depicted embodiment, the movable part 34 may move in a plurality of degrees of freedom relative to the base support 32 as the movable part 34 moves towards the belt releasing position. This may make the motion smoother, and/or allow a very close contact between machining tool 16 and the mobile part 34 to be maintained through the whole belt loading process. Engagement of the guiding pins PP into the holes HH may be a sliding engagement and/or the movable part 34 may be slidably engaged with the base support 32 in at least some embodiments. Movement may be in less degrees of freedom in other embodiments, either translational and/or rotational. In an embodiment, for instance, movement of the movable part 34 relative to the base support 32 may be in a single degree of freedom, in translation, solely along displacement axis Y.

The bias is provided via a biasing member 42 between the base support 32 and the movable part 34. In the depicted embodiment, the biasing member 42 includes a spring. There may be a plurality of biasing members 42 to bias the movable part 34 relative to the base support 32. For instance, in an embodiment, there may be a pair of biasing members 42, aligned with respective ones of the guiding pins PP (discussed above). Different types of biasing member(s) may be contemplated. For example, one or more leaf spring(s) or blade(s), torsion spring(s), elastically deformable member(s), such as elastomeric bumper(s), etc. Other resilient components, or a plurality of resilient components forming parts of the biasing member(s) may be contemplated. A material of such biasing member(s) may be an elastomer, fiber-reinforced composite, metallic, as some possibilities. In FIG. 4B, the biasing member is shown in an extended state and in FIG. 5B the biasing member is shown in a collapsed state. The biasing member 42 opposes (partially) to the movement of the movable part 34 relative to the base support 32 during movement between the biased position and the belt releasing position. As shown in FIGS. 4B and 5B, the biasing member 42 is seated at opposite ends in a seating portion defined in respective ones of the base support 32 and the movable 34. The basing member 42 may be secured in a fixed position relative to the base support 32 and the movable part 34, or only mechanically constrained between these two parts, for instance by the seating portions, or in other suitable ways. The guiding pins PP may maintain the movable part 34 in the biased position shown in FIG. 4B, hence force against the biasing member 42 in this position, in some embodiments (e.g., where the biasing member 42 is in a compressed state in the biased position and/or not at rest or fully extended).

Figures 6A, 6B, 6C:
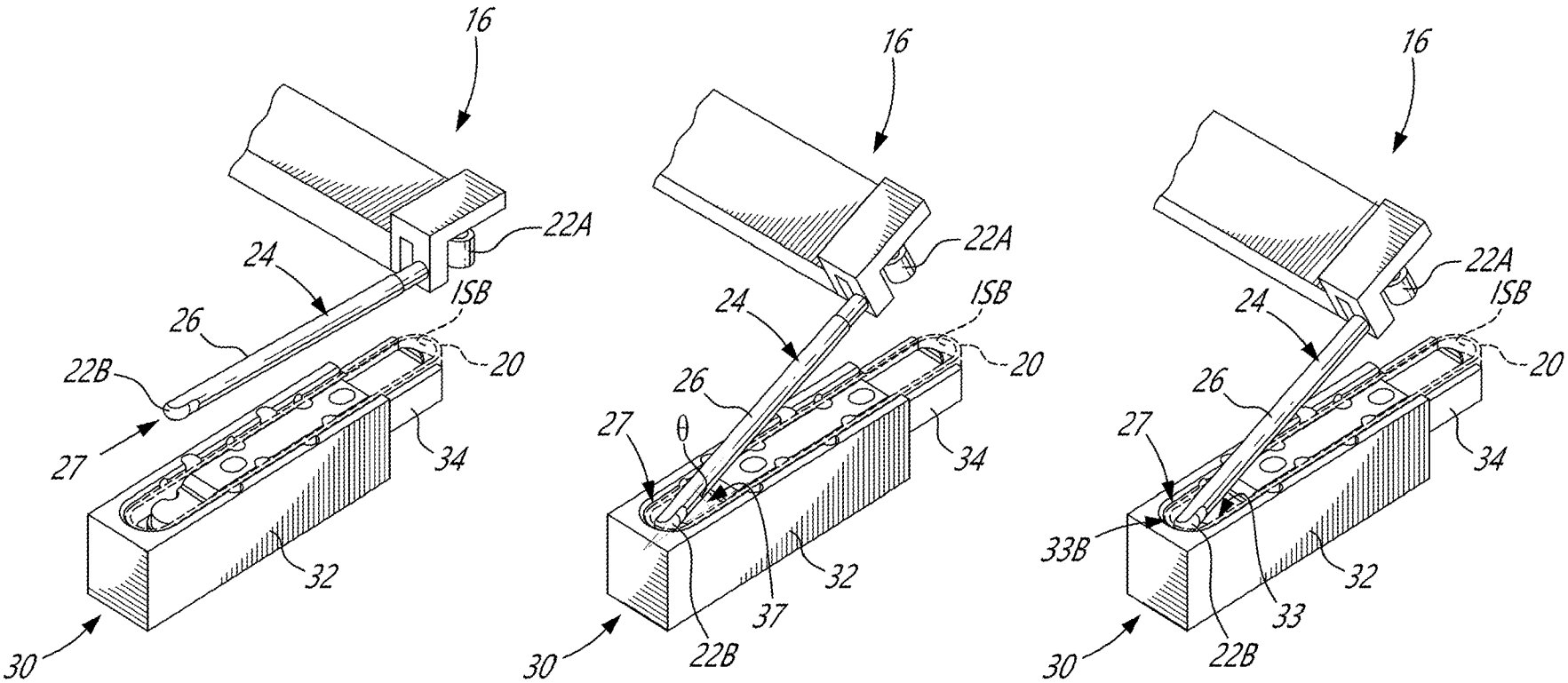
FIGS. 6A-6F illustrate frame shots of a belt loading process with the belt loading device of FIGS. 3 to 5B, according to an embodiment.

Referring to FIGS. 6A-6F, a method for loading a belt on a machining tool such as the machining tool 16 described herein as part of an automated machining operation is described. The method includes engaging a first end portion, such as the driven idler 22B at the end 27, of the machining tool 16, with the inner surface ISB of the belt 20; applying a pressure against the inner surface ISB of the belt 20 with such end portion to retract a belt engaging portion, such as the tensioner 24 with the extendable rod 26 of the machining tool 16; engaging a second end portion, such as the driving idler 22A (or an abutment part), of the machining tool 16, with the movable part 34 of the belt loading device 30 so as to displace the movable part 34 from the biased position to the belt releasing position, releasing the pressure at the end 27 of the machining tool 16 to gain an elongated state of the belt engaging portion of the machining tool 16, engaging the inner surface ISB of the belt 20 with the second end portion, opposite the first end portion, and disengaging the machining tool 16 from the belt loading device 30. FIG. 6A shows the machining tool 16 in approach towards the belt loading device 30.

As shown in FIG. 6B, in some embodiments, the engagement of the first end portion, such as the driven idler 22B, is at angle θ relative to a projection line normal to the inner surface ISB of the belt 20. The angle may be measured between the projection line normal to the inner surface ISB of the belt 20 and a projection line extending along the extendable rod 26 at the end 27. Such angle θ may be between 0° and 45° in at least some embodiments. In a particular embodiment, the angle θ is 15±10°. Minimizing the angle θ may limit or prevent undesirable movement and/or deformation of the belt 20 at contact, and/or a moment from being applied on the belt 20, which could lead to the belt 20 twisting upwards and ultimately leaving the device 30 before the tensioner compression is achieved. Angle higher than 45° could be contemplated in some other cases. Minimizing the angle may maximize belt stability whilst also minimizing cycle time (e.g., less distance to travel during pivot motion onto mobile part 34).

In at least some embodiments, the machining tool 16 does not contact the movable part 34 as the end 27 and/or driven idler 22B initiates engagement with the inner surface ISB of the belt 20. As described above, the end 27, which includes the driven idler 22B in the depicted embodiment, may be inserted in the recess 37, at least partially, as the driven idler 22B engages with the inner surface ISB. As shown, in FIG. 6C, upon application of the pressure on the inner surface ISB, the belt 20 may contact the closed end 33B of the slot 33 in the base support 32 as the machining tool 16 engages the inner surface ISB of the belt 20 in the radius corner 20B. As shown in FIG. 6C, the driven idler 22B at the end of the extendable rod 26 of the machining tool 16 may abut against the closed end 33B of the slot 33, via contact with the belt 20, to retract the extendable rod 26 as the machining tool 16 initiates engagement with the belt 20 at the closed end 33B.

Figure 6F:
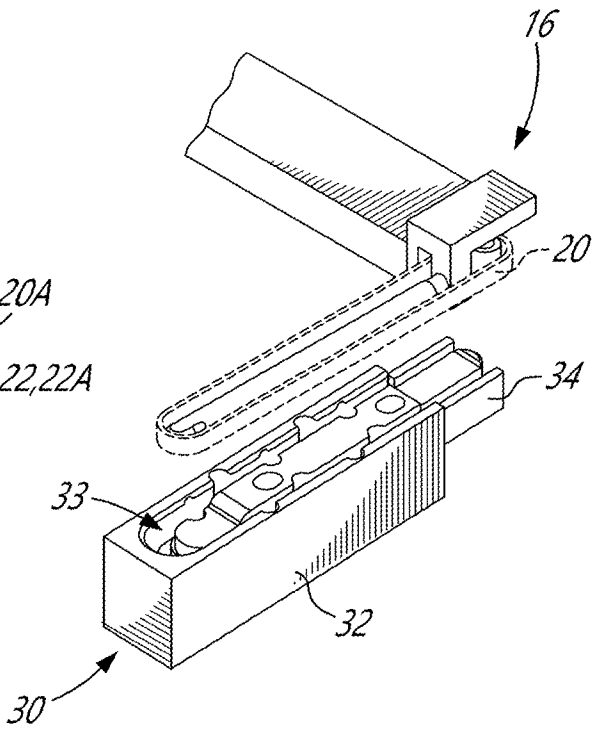
Figure 6E:
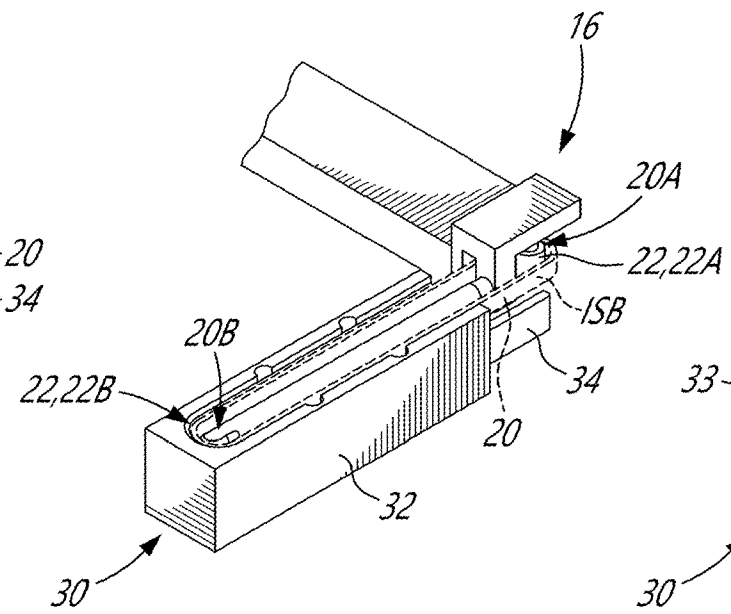
Figure 6D:
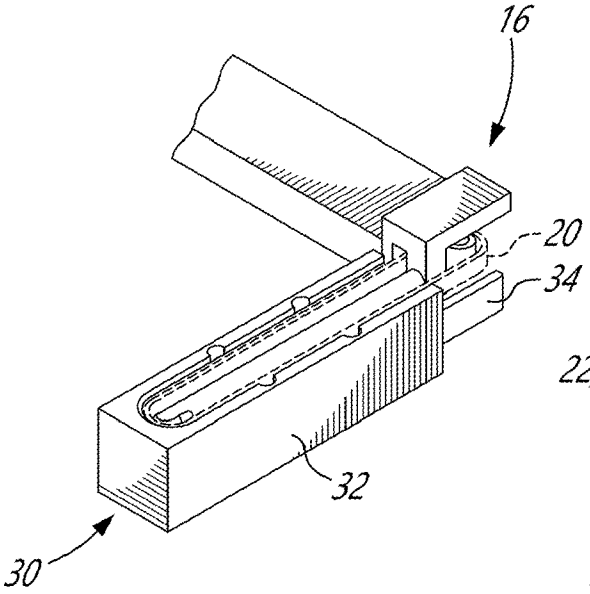

As shown in FIG. 6D, to reach the belt releasing position, the movable part 34 is pushed against the biasing member 42, by the machining tool 16 contacting the movable part 34. As the movable part 34 retracts towards the belt releasing position, the machining tool 16 may take up a space left by the movable part 34 within the base support 32. As the movable part 34 progresses towards the belt releasing position, the biasing member 42 (not shown in FIG. 6D, but see FIGS. 4B, 5B) is compressed between the movable part 34 and the base support 32.

As shown in FIG. 6E, releasing the tensioner 24, the driving idler 22A of the machining tool 16 may engage the inner surface ISB of the belt 20 when the movable part 34 is in the belt releasing position. Both idlers 22 of the machining tool 16 may thus engage freely with no interference of friction with the inner surface ISB of the belt 20, in the radius corners 20A, 20B of the belt 20. The release of the tensioner 24 may then result in the engagement by both idlers 22 which may cause a tension in the belt 20. Driving engagement of the belt 20 with the idlers 22 may be obtained by friction, which may result from the tension. Such tension may be obtained by the extendable rod of the machining tool 16 biased in its extended state by the biasing member 28.

As shown in FIG. 6F, the removal of the machining tool 16 from the space in the slot 33 left by the movable part 34 in the belt releasing position may disengage the machining tool 16 from the movable part 34. The movable part may thus return to its biased position. The belt 20 is freed from the belt loading device 30 by the machining tool 16 moving away from the belt loading device 30, with the belt 20 on the machining tool 16.

Figure 7:
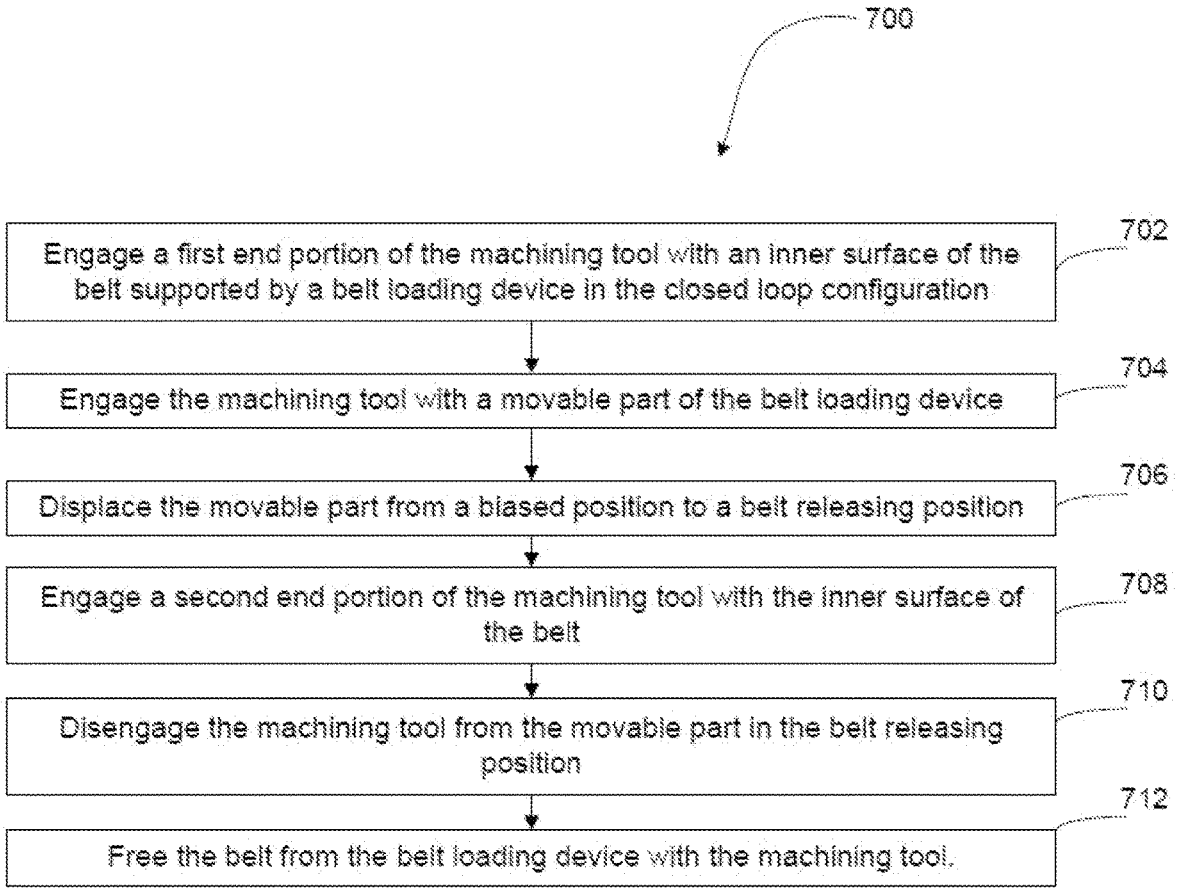
FIG. 7 is a flow chart of an exemplary belt loading process with the belt loading device of FIGS. 3 to 5B, according to an embodiment.

A belt loading process/method 700 is represented in a flow chart at FIG. 7 according to an embodiment. The method includes the following steps: engaging a first end portion of the machining tool 16 with the inner surface ISB of the belt 20 supported by the belt loading device 30 in the closed loop configuration (702); engaging the machining tool 16 with the movable part 34 of the belt loading device 30 (704); displacing the movable part 34 from a biased position to a belt releasing position (706); engaging a second end portion of the machining tool 16 with the inner surface ISB of the belt 20 (708); disengaging the machining tool 16 from the movable part 34 in the belt releasing position (710); and freeing the belt 20 from the belt loading device 30 with the machining tool 16 (712).

In at least some embodiments, at least one of the engaging the first end portion and the engaging of the second end portion includes applying a pressure on the inner surface ISB of the belt 20 via an idler 22 of the machining tool.

In at least some embodiments, the engaging the first end portion includes engaging an idler 22 of the machining tool 16 at an angle θ between 0° and 45° relative to a projection line normal to the inner surface ISB of the belt 20.

In at least some embodiments, the engaging the first end portion includes inserting at least partially an idler 22 of the machining tool 16 in a space 37S defined by a recess 37 in the movable part.

In at least some embodiments, the engaging the first end portion includes retracting an extendable rod 26 of the machining tool 16 from an elongated state to a retracted state.

In at least some embodiments, the engaging the second end portion includes gaining an elongated state of an extendable rod 26 of the machining tool 16.

In at least some embodiments, the engaging the second end portion includes releasing a pressure at the first end portion of the machining tool 16 against the inner surface ISB of the belt 20.

In at least some embodiments, the displacing the movable part 34 from the biased position to the belt releasing position includes taking up a space left by the movable part 34 within a base support 32 of the loading device 30 with the machining tool 16.

In at least some embodiments, the displacing the movable part 34 from the biased position to the belt releasing position includes removing the movable part 34 from a tool engaging area circumscribed by the inner surface ISB of the belt 20 and inserting part of the machining tool 16 in the tool engaging area.

In at least some embodiments, the displacing the movable part 34 from the biased position to the belt releasing position includes moving the movable part 34 in a single degree of freedom in translation relative to a base support 32 of the belt load device 30.

The belt loading device 30 described herein with respect to various embodiments may be manufactured using one or more manufacturing technique, e.g., machining, casting, molding, additive manufacturing.

The belt loading device 30 as described herein may allow repeatability in use, facilitate handling and/or loading/unloading the belt 20 thereto/therefrom in an automated machining operation, such as a surface treatment operation mentioned herein, via suitable programming of the robot 12 to perform the movement of the machining tool 16 of the method described herein.

The embodiments described in this document provide non-limiting examples of possible implementations of the present technology. Upon review of the present disclosure, a person of ordinary skill in the art will recognize that changes may be made to the embodiments described herein without departing from the scope of the present technology. For example, while the present disclosure described the work cell 10 including the machining tool 16 in the context of a polishing process of a component, such as an aircraft engine component, the present disclosure may also apply to other practical applications involving an automated surface treatment or material removal process. As another example, while the belt loading device 30 is passive, i.e. unpowered, the belt loading device 30 may be actuated with one or more actuators, to displace the movable part 34 relative to the base support 32, for instance. In such case, the biasing member may not be present or be operatively coupled with the one or more actuators to bias the movable part 34 in the biased position and/or control movement of the movable part 34 relative to the base support 32. As another example, in other applications, the driving idler 22A could be in contact with the inner surface ISB while the tensioner 24 is being compressed and the driven idler 22B inserted last, during motion onto the mobile part 34.

Yet further modifications could be implemented by a person of ordinary skill in the art in view of the present disclosure, which modifications would be within the scope of the present technology.

The invention claimed is:

1. A belt loading device, comprising:

an abrasive belt having a closed loop configuration, the abrasive belt configured to be loaded onto a machining tool;

a base support defining a slot extending lengthwise along a longitudinal axis, the slot having an open top along the longitudinal axis, the abrasive belt longitudinally received in the slot along the longitudinal axis and accessible via the open top of the slot;

a movable part engaged in the slot of the base support, the movable part movable relative to the base support towards and away from the open top of the slot in a direction transversal to longitudinal axis between a biased position and a belt releasing position in which the movable part is retracted into the slot at least partly below plateaued surfaces facing upwardly along opposed longitudinal sides of the slot for providing a bottom support to the abrasive belt inside the slot, the base support and the movable part, while in the biased position, cooperating to maintain the abrasive belt in a fixed position defining a tool engaging area circumscribed by an inner surface of the abrasive belt; and a biasing member interfacing between the base support and the movable part to bias the movable part along the transversal direction into the biased position towards the open top of the slot of the base support;

wherein at least part of the movable part is recessed in the slot in the biased position and in the belt releasing position; and wherein the slot is open-ended at an end thereof along the longitudinal axis, the movable part extends beyond a side of the base support, beyond the open-ended end of the slot.

2. The belt loading device as defined in claim 1, wherein the slot includes a closed end along the longitudinal axis, the closed end defining a radius corner for engaging with an outer surface of the abrasive belt.

3. The belt loading device as defined in claim 1, wherein the base support and the movable part in the biased position define opposite walls facing each other, a gap is defined between the opposite walls, the abrasive belt received in the gap.

4. The belt loading device as defined in claim 3, wherein the gap has a gap distance adapted to be between 100% and 200% of a thickness of the abrasive belt.

5. The belt loading device as defined in claim 1, wherein the movable part in the biased position occupies at least part of the tool engaging area to extend along a substantial portion of the inner surface of the abrasive belt.

6. The belt loading device as defined in claim 1, wherein the movable part has a portion extending beyond the open-ended end of the slot, and wherein the portion of the movable part includes outer support walls facing an outer surface of the abrasive belt when the movable part is in the biased position.

7. The belt loading device as defined in claim 6, wherein the base support and the movable part in the biased position define opposite walls facing each other, a gap is defined between the opposite walls, the abrasive belt received in the gap, the gap extends beyond the open-ended end of the slot, between the outer support walls and the wall of the movable part facing that of the base support.

8. The belt loading device as defined in claim 1, wherein the movable part has a recess defined in an upper face thereof, the recess located at an end of the movable part.

9. A belt loading device, comprising:

an abrasive belt having a closed loop configuration, the abrasive belt configured to be loaded onto a machining tool;

a base support defining a slot extending lengthwise along a longitudinal axis, the slot having an open top along the longitudinal axis, the abrasive belt longitudinally received in the slot along the longitudinal axis and accessible via the open top of the slot;

a movable part engaged in the slot of the base support, the movable part movable relative to the base support towards and away from the open top of the slot in a direction transversal to longitudinal axis between a biased position and a belt releasing position in which the movable part is retracted into the slot at least partly below plateaued surfaces facing upwardly along opposed longitudinal sides of the slot for providing a bottom support to the abrasive belt inside the slot, the base support and the movable part, while in the biased position, cooperating to maintain the abrasive belt in a fixed position defining a tool engaging area circumscribed by an inner surface of the abrasive belt; and a biasing member interfacing between the base support and the movable part to bias the movable part along the transversal direction into the biased position towards the open top of the slot of the base support;

wherein the slot has an open-ended end along the longitudinal axis, a portion of the movable part extends beyond a side of the base support, beyond the open-ended end of the slot, the portion of the movable part includes outer support walls facing an outer surface of the abrasive belt when the movable part is in the biased position.

10. The belt loading device as defined in claim 9, wherein the base support and the movable part in the biased position define opposite walls facing each other, a gap is defined between the opposite walls, the abrasive belt received in the gap, the gap extends beyond the open-ended end of the slot, between the outer support walls and the wall of the movable part facing that of the base support.

11. The belt loading device as defined in claim 10, wherein the slot includes a closed end along the longitudinal axis, the closed end defining a radius corner for engaging with an outer surface of the abrasive belt.

12. The belt loading device as defined in claim 9, wherein the base support and the movable part in the biased position define opposite walls facing each other, a gap is defined between the opposite walls, the abrasive belt received in the gap.

13. The belt loading device as defined in claim 12, wherein the gap has a gap distance adapted to be between 100% and 200% of a thickness of the abrasive belt.

14. The belt loading device as defined in claim 12, wherein the movable part in the biased position occupies at least part of the tool engaging area to extend along a substantial portion of the inner surface of the abrasive belt.

* * * * *